US005900842A

United States Patent [19]

Coleman

[11] Patent Number: 5,900,842

[45] Date of Patent: May 4, 1999

[54] INEXPENSIVE DIRECTIONAL ANTENNA THAT IS EASILY TUNED AND WEATHER RESISTANT

[75] Inventor: George Warren Coleman, Acworth, Ga.

[73] Assignee: Lucent Technologies, Inc., Murray Hill, N.J.

[21] Appl. No.: 08/937,346

[22] Filed: Sep. 20, 1997

[51] Int. Cl.[6] ..... H01Q 11/12

[52] U.S. Cl. ..... 343/742; 343/867; 343/890

[58] Field of Search ..... 343/742, 744, 343/752, 890, 866, 867

[56] References Cited

U.S. PATENT DOCUMENTS

| | | | |
|---|---|---|---|
| 3,345,635 | 10/1967 | Fenwick et al. | 343/752 |
| 3,623,110 | 11/1971 | Doi et al. | 343/744 |
| 4,138,682 | 2/1979 | Doherty | 343/742 |
| 4,152,708 | 5/1979 | Boucher | 343/880 |
| 4,229,724 | 10/1980 | Rotunda | 343/742 |
| 4,236,160 | 11/1980 | Johnson | 343/743 |
| 4,338,606 | 7/1982 | Tada et al. | 343/744 |
| 4,433,336 | 2/1984 | Carr | 343/742 |
| 4,595,928 | 6/1986 | Wingard | 343/742 |
| 5,673,055 | 9/1997 | Hansen | 343/890 |
| 5,701,130 | 12/1997 | Thill et al. | 343/742 |

FOREIGN PATENT DOCUMENTS

| | | | |
|---|---|---|---|
| 1117068 | 3/1958 | France | 343/742 |

OTHER PUBLICATIONS

"A 28–MHz Swiss Quad," The ARRL Antenna Book, 1994, pp. 12–17 to 12–19.

*Primary Examiner*—Don Wong
*Assistant Examiner*—Tan Ho

[57] ABSTRACT

An antenna array is disclosed in which a central vertical mast supports four radially extending struts. One loop of conducting elements, the director, is supported on the mast above the struts, on the mast below the struts and at the centrifugal end of two adjacent struts. A second loop of conducting elements, the reflector, is also supported on the mast above the struts and on the mast below the struts, and at the centrifugal end of the other two remaining struts. When the length of the director loop is smaller than the reflector loop and the reflector and director are both driven 180° out-of-phase of each other, the antenna functions similarly to a Swiss Quad antenna, but has structural and weather-resistant advantages over the Swiss Quad.

15 Claims, 3 Drawing Sheets

INEXPENSIVE DIRECTIONAL ANTENNA THAT IS EASILY TUNED AND WEATHER RESISTANT

FIELD OF THE INVENTION

The present invention relates to antennas in general, and, more particularly, to a directional array antenna.

BACKGROUND OF THE INVENTION

FIG. 1 depicts an isometric drawing of a Swiss Quad antenna in the prior art. The Swiss Quad antenna of FIG. 1 comprises: mast 101, H-X support 103, H-X support 104, reflector 105 and director 106. The Swiss Quad antenna of FIG. 1 is advantageous because: (1) of the degree of its directivity, (2) its small Turning radius, (3) its lightweight but strong design, and (4) the fact that the two antenna elements, reflector 105 and director 106, can be electrically grounded to mast 101, using "plumber's delight construction." It is well known to those skilled in the art how to make and use Swiss Quad antenna 100. See "A 28-MHz Swiss Quad," *The ARRL Antenna Book,* The American Radio Relay League, pp. 12-7 to 12-9 (1994).

A Swiss Quad antenna has several disadvantages, however. First, H-X support 103 and H-X support 104 require a substantial amount of building materials and the builder must be meticulous during construction for the antenna to operate effectively. Second, a portion of both reflector 105 and director 106 are horizontal (the portions parallel with H-X support 103 and H-X support 104), which encourages ice-buildup on reflector 105 and director 106 in winter. Ice-buildup is disadvantageous because it reduces the effectiveness of the antenna. And third, a Swiss Quad antenna is very tedious to tune because each tuning step requires the removal of four vertical segments of reflector 105 and director 106 that are precisely the same length. In otherwords, a Swiss Quad is not robust to minor mistakes made in tuning the antenna.

Therefore, the need exists for an antenna that has the advantages of a Swiss Quad but that uses fewer building materials, that inhibits icing and that is easier to tune.

SUMMARY OF THE INVENTION

Some embodiments of the present invention function as a directional antenna as well as a Swiss Quad antenna without some of the costs and restrictions associated with a Swiss Quad antenna in the prior art. In particular, some embodiments of the present invention are less costly to manufacture than a Swiss Quad antenna because the embodiments require fewer structural components yet still provide a strong, lightweight design. Furthermore, some embodiments of the present invention use diagonal conducting elements, which are less likely to ice than the horizontal conducting elements used in a Swiss Quad antenna. Furthermore, some embodiments of the present invention enable a simple, robust mechanism for fine-tuning the antenna.

These advantages can be found in an embodiment of the present invention in which a central vertical mast supports four radially extending struts. One loop of conducting elements, the director, is supported on the mast above the struts, on the mast below the struts and at the centrifugal end of two adjacent struts. A second loop of conducting elements, the reflector, is also supported on the mast above the struts and on the mast below the struts, and at the centrifugal end of the other two remaining struts. When the length of the director loop is smaller than the reflector loop and the reflector and director are both driven 180° out-of-phase of each other, the antenna functions similarly to Swiss Quad antennas in the prior art.

DETAILED DESCRIPTION

Figure 1:
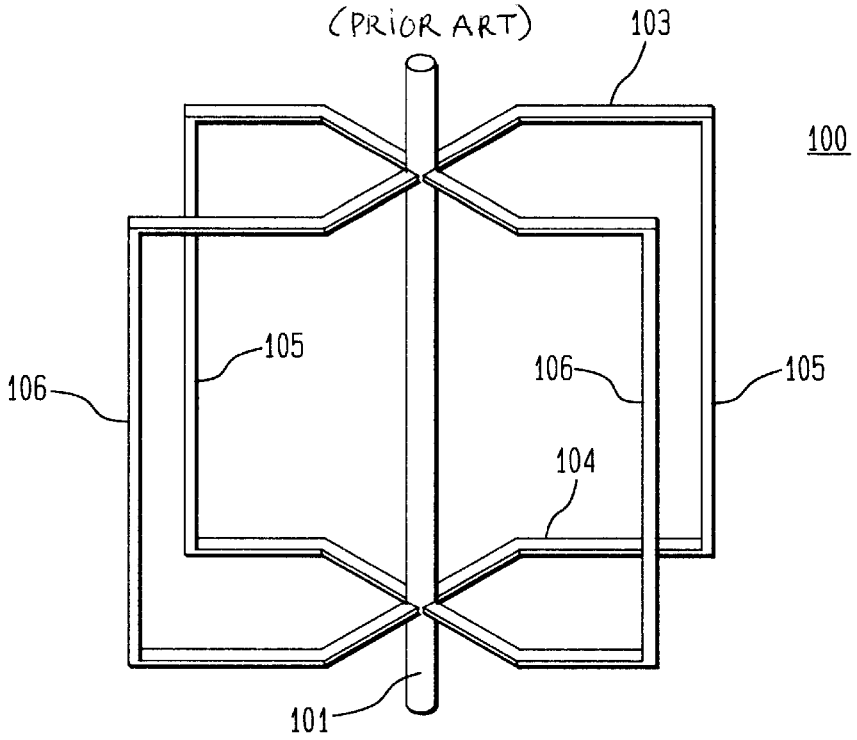
FIG. 1 (PRIOR ART)
FIG. 1 depicts a schematic diagram of a Swiss Quad antenna in the prior art.
Figure 2:
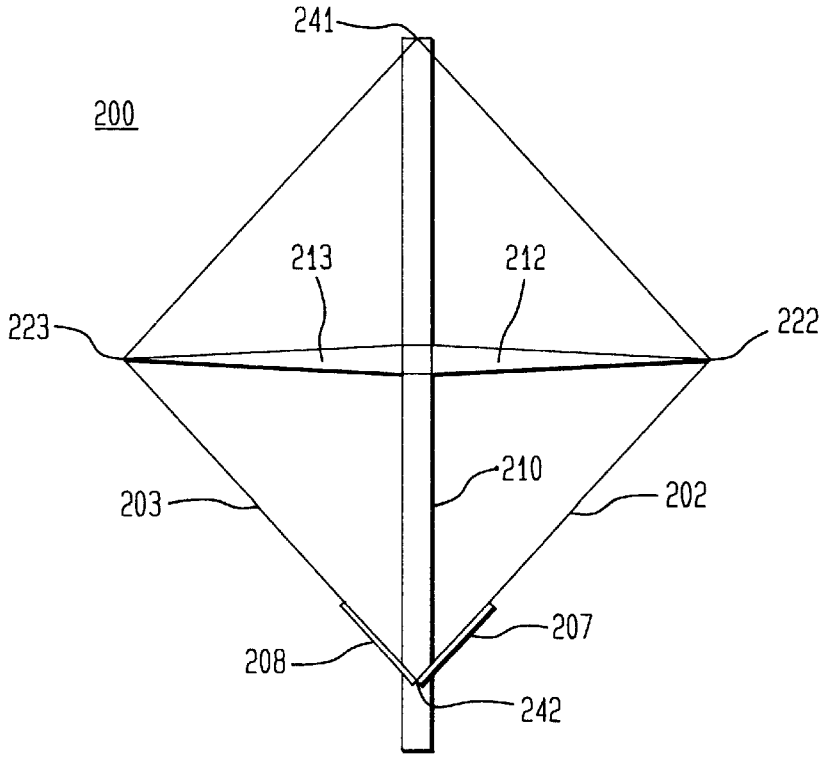
FIG. 2 depicts a front view of an antenna in accordance with the illustrative embodiment.
Figure 3:
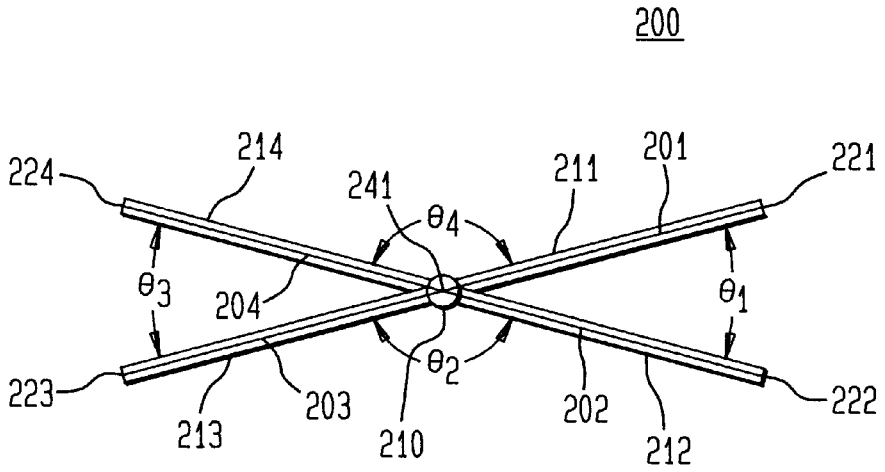
FIG. 3 depicts a top view of the antenna in FIG. 2.
Figure 4:
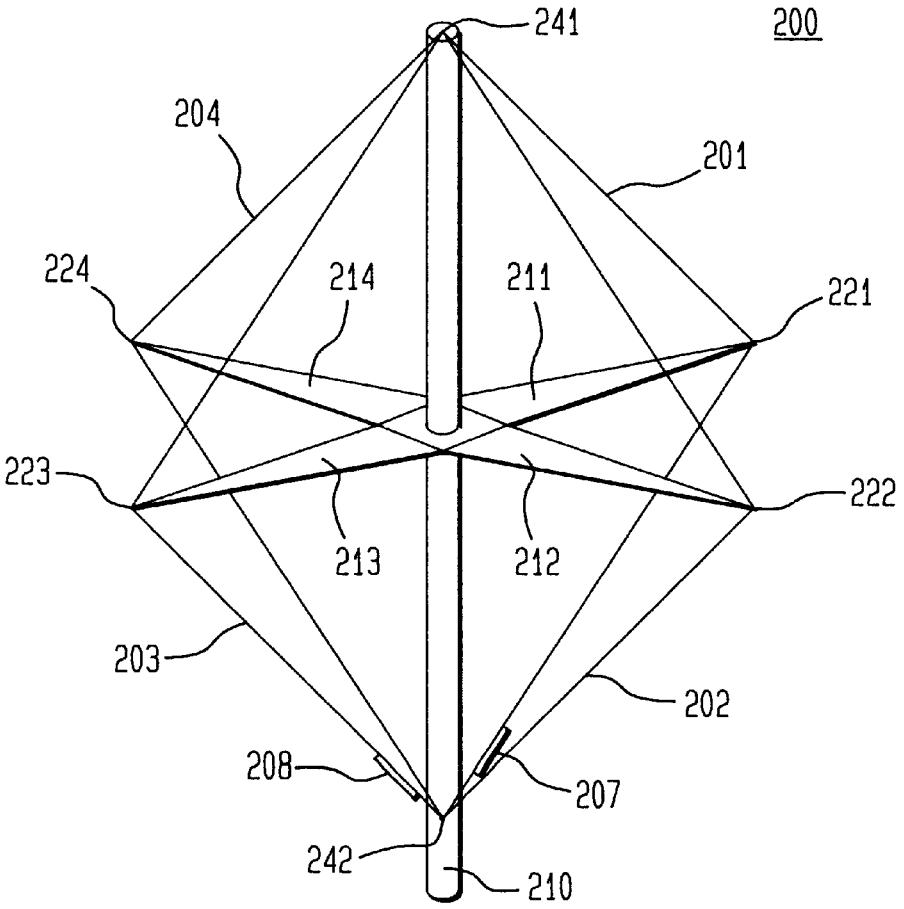
FIG. 4 depicts an isometric view of the antenna in FIG. 2.

FIG. 2 depicts a top view of an antenna in accordance with the illustrative embodiment of the present invention; FIG. 3 depicts a top view of the antenna of FIG. 2 and FIG. 4 depicts an isometric view of the antenna of FIG. 2. Antenna 200 advantageously has radiation and electrical characteristics that are similar to that of a Swiss Quad antenna.

The illustrative embodiment advantageously comprises: mast 210, structural member 211, structural member 212, structural member 213, structural member 214, electrical conductor 201, electrical conductor 202, electrical conductor 203, electrical conductor 204, gamma match 207 and gamma match 208.

Mast 210 is a structural member that is either a conductor or a non-conductor and that is strong enough to support the weight of antenna 200. Structural member 211, structural member 212, structural member 213 and structural member 214 are advantageously supported by mast 210 and extend radially from mast 210. structural member 211, structural member 212, structural member 213 and structural member 214 are advantageously nonconductors, or are insulated from the electrical conductors by an insulator. Antenna 200 can be fabricated using plumber's delight type construction.

Electrical conductor 201 advantageously extends from a first point, point 241 on mast 210 to the centrifugal end of structural member 211 and to a second point, point 242 on mast 210. The centrifugal end of structural member 211 holds electrical conductor 201 at point 221 and point 241, point 242 and point 221 lie in a first plane.

Electrical conductor 202 advantageously extends from a first point, point 241 on mast 210 to the centrifugal end of structural member 212 and to a second point, point 242 on mast 210. The centrifugal end of structural member 212 holds electrical conductor 202 at point 222 and point 241, point 242 and point 222 lie in a second plane.

Electrical conductor 203 advantageously extends from a first point, point 241 on mast 210 to the centrifugal end of structural member 213 and to a second point, point 242 on mast 210. The centrifugal end of structural member 213 holds electrical conductor 203 at point 223 and point 241, point 242 and point 223 lie in a third plane.

Electrical conductor 204 advantageously extends from a first point, point 241 on mast 210 to the centrifugal end of structural member 214 and to a second point, point 242 on mast 210. The centrifugal end of structural member 214 holds electrical conductor 204 at point 224 and point 241, point 242 and point 224 lie in a fourth plane.

Advantageously, the dihedral angle, $\theta_1$, between the first plane and the second plane and the dihedral angle, $\theta_3$, between the third plane and the fourth plane are congruent. In particular, $\theta_1$ and $\theta_3$ are each between 30° and 35°, and in particular 32°. Advantageously, the dihedral angle, $\theta_2$, between the second plane and the third plane, and the dihedral angle, $\theta_4$, between the fourth plane and the third plane are congruent. In particular, $\theta_2$ and $\theta_4$ are each between 145° and 150°, and in particular 148°. When the four dihedral angles are within the stated ranges, the radiation pattern of antenna 200 is quite similar to the radiation pattern of a Swiss Quad antenna. It will be clear to those skilled in the art how to determine the best angle for $\theta_1$, $\theta_2$, $\theta_3$ and $\theta_4$ given the diameter of the electrical conducting elements using antenna modeling software. For symmetry about the axis of maximum radiation it is advantageous to have $\theta_1$ and $\theta_3$ congruent, but $\theta_2$ and $\theta_4$ can vary to accomodate the modeling process.

Electrical conductor 201 and electrical conductor 204 form a loop that is the antenna's director. The length of electrical conductor 201 advantageously equals the length of electrical conductor 204 and the sum of their lengths advantageously equals 1.092λ, where λ equals the wavelength at which antenna 200 is designed to radiate.

Electrical conductor 202 and electrical conductor 203 form a loop that is the antenna's reflector. The length of electrical conductor 202 advantageously equals the length of electrical conductor 203 and the sum of their lengths advantageously equals 1.148λ, where λ equals the wavelength at which antenna 200 is designed to radiate.

Advantageously, gamma match 207 feeds electrical conductor 201 and gamma match 208 feeds electrical conductor 203. It will be clear to those skilled in the art that gamma match 207 and gamma match 208 can constitute a T-match section, for example, by feeding conductor 202 in lieu of conductor 203. The antenna director and antenna reflector can both be fed at point 241 or at point 242, in well-known fashion. When mast 210 is vertically oriented, antenna 200 is horizontally polarized; when mast 210 is horizontally oriented, antenna 200 is vertically polarized. Advantageously, the antenna director is driven 180° out-of-phase from the antenna reflector and both the antenna director and the antenna reflector are driven at the same frequency, in well-known fashion.

Electrical conductor 201, electrical conductor 202, electrical conductor 203 and electrical conductor 204 can be electrically connected at point 241 and point 242, which are both current nodes. Point 221, point 222, point 223 and point 224 are advantageously voltage nodes. Antenna 200 is advantageously fine-tuned by sliding the connector at either point 241 or point 242 or both up and down mast 210 and by shortening or lengthening electrical conductor 201, electrical conductor 202, electrical conductor 203 and electrical conductor 204 appropriately. Advantageously, the angle between point 241 and point 242 with the centrifugal end of each structural member at the vertex is maintained at 90° during tuning. It will be clear to those skilled in the art how to make and use antenna 200, and how to use antenna modeling software to predict the antenna radiation pattern for any given set of desired parameters.

Figure 5:
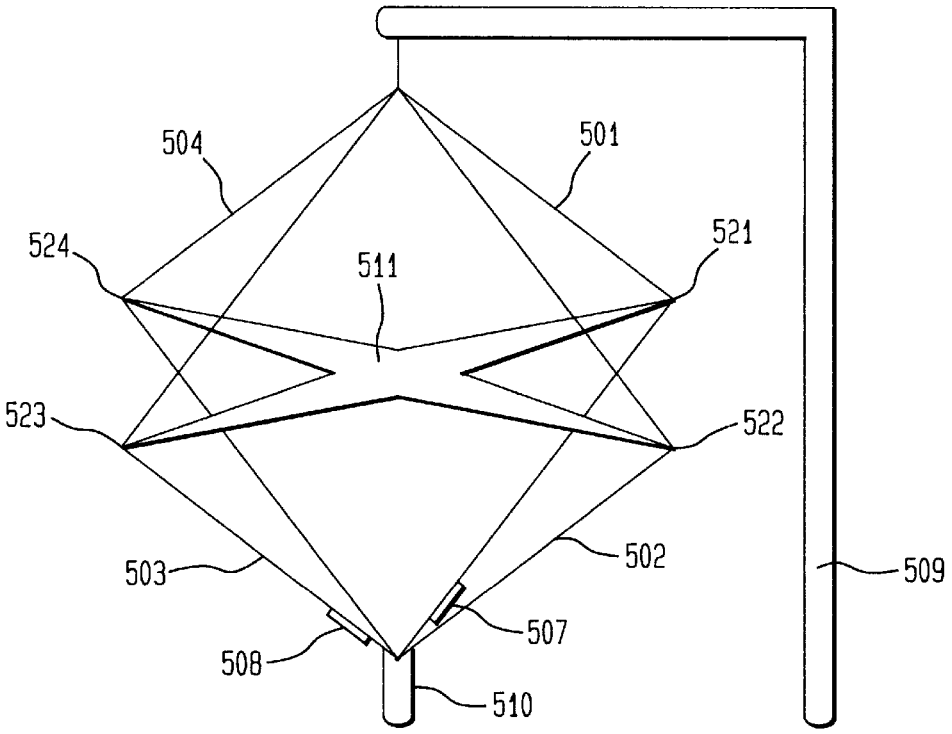
FIG. 5 depicts an isometric drawing of a second illustrative embodiment of the present invention.

FIG. 5 depicts an isometric drawing of a second illustrative embodiment of the present invention in which the central mast of the first illustrative embodiment is replaced with an external mast from which the electrical conductors are suspended. In this embodiment, a single four-pronged compression member is supported by the four electrical conductors and is responsible for the determining the relative spacing of points 521, 522, 523 and 524. The illustrative embodiment of FIG. 5 operates in the same manner as the first illustrative embodiment and it will be clear to those skilled in the art how to make and use the embodiment in FIG. 5.

Figure 6:
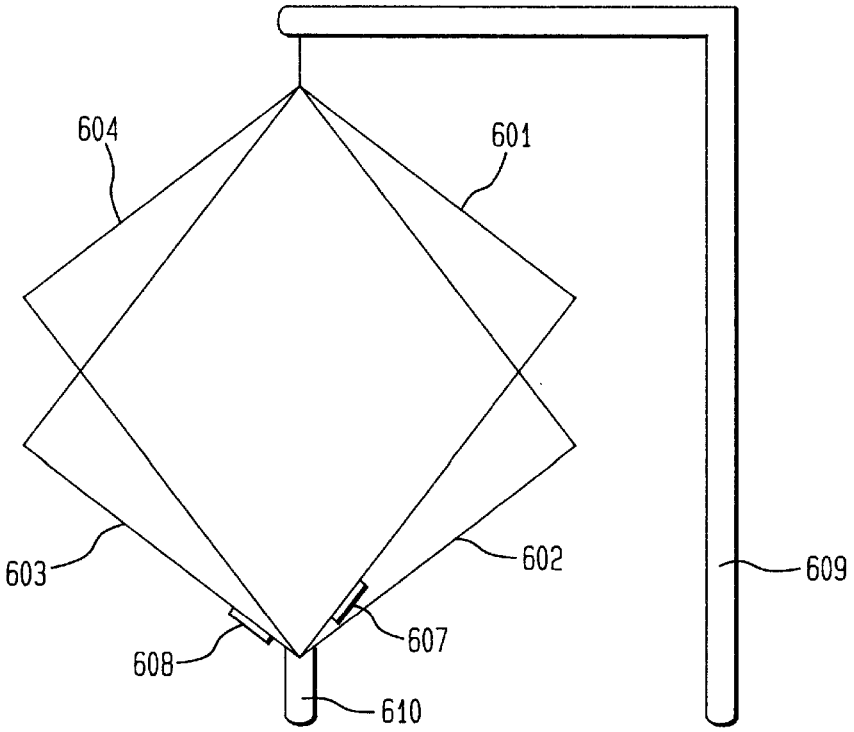
FIG. 6 depicts an isometric drawing of a third illustrative embodiment of the present invention.

FIG. 6 depicts an isometric drawing of a third illustrative embodiment of the present invention in which the four-pronged compression member of the second illustrative embodiment is eliminated and rigid electrical conductors are used that are capable of maintaining the desired geometry. The illustrative embodiment of FIG. 6 operates in the same manner as the first illustrative embodiment and it will be clear to those skilled in the art how to make and use the embodiment in FIG. 6.

It is to be understood that the above-described embodiments are merely illustrative of the invention and that many variations may be devised by those skilled in the art without departing from the scope of the invention. It is therefore intended that such variations be included within the scope of the following claims.

What is claimed is:

1. An antenna comprising:

a mast;

a first structural member having a first end and a second end, wherein said first end is supported by said mast and said first structural member extends radially from said mast;

a second structural member having a first end and a second end, wherein said first end is supported by said mast and said second structural member extends radially from said mast;

a third structural member having a first end and a second end, wherein said first end is supported by said mast and said third structural member extends radially from said mast;

a fourth structural member having a first end and a second end, wherein said first end is supported by said mast and said fourth structural member extends radially from said mast;

a first electrical conductor extending from a first point on said mast to said second end of said first structural member and from said second end of said first structural member to a second point on said mast, wherein said first point on said mast, said second point on said mast, said second end of said first structural member lie in a first plane;

a second electrical conductor extending from said first point on said mast to said second end of said second structural member and from said second end of said second structural member to said second point on said mast, wherein said first point on said mast, said second point on said mast, said second end of said second structural member lie in a second plane;

a third electrical conductor extending from said first point on said mast to said second end of said third structural member and from said second end of said third structural member to said second point on said mast, wherein said first point on said mast, said second point on said mast, said second end of said third structural member lie in a third plane;

a fourth electrical conductor extending from said first point on said mast to said second end of said fourth structural member and from said second end of said fourth structural member to said second point on said mast, wherein said first point on said mast, said second point on said mast, said second end of said fourth structural member lie in a fourth plane;

wherein said first electrical conductor, said second electrical conductor, said third electrical conductor, and said fourth electrical conductor are all electrically connected at said first point and at said second point; and wherein said first electrical conductor, said second electrical conductor, said third electrical conductor, and said fourth electrical conductor are all driven simultaneously.

2. The antenna of claim 1 wherein said first plane and said second plane intersect at a dihedral angle, $\theta_1$, between 30° and 35°, said second plane and said third plane intersect at a dihedral angle, $\theta_2$, between 145° and 150°, said third plane and said fourth plane intersect at a dihedral angle, $\theta_3$, between 30° and 35°, and said fourth plane and said first plane intersect at a dihedral angle, $\theta_4$, between 145° and 150°.

3. The antenna of claim 1 wherein said dihedral angle $\theta_1$ equals 32°, said dihedral angle $\theta_2$ equals 148°, said dihedral angle $\theta_3$ equals 32°, and said dihedral angle $\theta_4$ equals 148°.

4. The antenna of claim 1 further comprising a first gamma-match that feeds said first conductor and said fourth conductor.

5. The antenna of claim 4 further comprising a second gamma-match that feeds said second conductor and said third conductor.

6. The antenna of claim 1 wherein said first conductor and said fourth conductor form a director and said second conductor and said third conductor form a reflector.

7. The antenna of claim 6 wherein said director is driven 180° out-of-phase from said reflector.

8. The antenna of claim 1 wherein said first point on said mast and said second point on said mast are current nodes, and said first electrical conductor at said second end of said first structural member, said second electrical conductor at said second end of said second structural member, said third electrical conductor at said second end of said third structural member, and said fourth electrical conductor at said second end of said fourth structural member are voltage nodes.

9. The antenna of claim 1 wherein said mast is vertically oriented and said antenna is horizontally polarized.

10. An antenna comprising a first linear electrical conductor extending from a first point in space to a second point in space and to a third point in space, wherein said first point, said second point and said third point lie in a first plane;

a second linear electrical conductor extending from said first point to a fourth point in space and to said third point, wherein said first point, said fourth point and said third point lie in a second plane;

a third linear electrical conductor extending from said first point to a fifth point in space and to said third point, wherein said first point, said fifth point and said third point lie in a third plane; and a fourth linear electrical conductor extending from said first point to a sixth point in space and to said third point, wherein said first point, said sixth point and said third point lie in a third plane;

wherein said first plane and said second plane intersect at a dihedral angle, $\theta_1$, between 30° and 35°, said second plane and said third plane intersect at a dihedral angle, $\theta_2$, between 145° and 150°, said third plane and said fourth plane intersect at a dihedral angle, $\theta_3$, between 30° and 35°, and said fourth plane and said first plane intersect at a dihedral angle, $\theta_4$, between 145° and 150°;

wherein said first electrical conductor, said second electrical conductor, said third electrical conductor, and said fourth electrical conductor are all electrically connected at said first point and at said second point; and wherein said first electrical conductor, said second electrical conductor, said third electrical conductor, and said fourth electrical conductor are all driven simultaneously.

11. The antenna of claim 10 wherein said dihedral angle $\theta_1$ equals 32°, said dihedral angle $\theta_2$ equals 148°, said dihedral angle $\theta_3$ equals 32°, and said dihedral angle $\theta_4$ equals 148°.

12. The antenna of claim 10 further comprising a first gamma-match that feeds said first conductor and said fourth conductor.

13. The antenna of claim 12 further comprising a second gamma-match that feeds said second conductor and said third conductor.

14. The antenna of claim 10 wherein said first conductor and said fourth conductor form a director and said second conductor and said third conductor form a reflector.

15. The antenna of claim 14 wherein said director is driven 180° out-of-phase from said reflector.

* * * * *